US006293195B1

(12) United States Patent
Allison, Jr.

(10) Patent No.: US 6,293,195 B1
(45) Date of Patent: Sep. 25, 2001

(54) CHAMBERED FLEXOGRAPHIC INK UNITS WITH QUICK-CHANGE, BLADE THICKNESS COMPENSATING CLAMPING MECHANISM

(75) Inventor: Thomas K. Allison, Jr., Moorestown, NJ (US)

(73) Assignee: Alhsontech Sales Incorporated, Moorestown, NJ (US)

( * ) Notice: Subject to any disclaimer, the term of this patent is extended or adjusted under 35 U.S.C. 154(b) by 0 days.

(21) Appl. No.: 09/411,677

(22) Filed: Oct. 7, 1999

Related U.S. Application Data

(60) Provisional application No. 60/103,369, filed on Oct. 7, 1998.

(51) Int. Cl.[7] ..... B41F 31/00; B41F 31/02

(52) U.S. Cl. ..... 101/350.6; 101/366

(58) Field of Search ..... 101/148, 160, 101/161, 165, 204, 207, 208, 210, 315, 321, 326, 330, 331, 344, 347, 350.1, 350.5, 366, 350.6, 355, 356, 360, 363, 364, 367

(56) References Cited

U.S. PATENT DOCUMENTS 3,783,781 * 1/1974 Grommek ..... 101/157
5,406,887 * 4/1995 Hertel et al. ..... 101/366
6,089,159 * 7/2000 Gorter ..... 101/366

* cited by examiner

*Primary Examiner*—Kimberly L. Asher
(74) *Attorney, Agent, or Firm*—Akin, Gump, Strauss, Hauer & Feld, L.L.P.

(57) ABSTRACT

A flexographic printer ink unit has an elongated body with an elongated ink chamber recessed into one side of the body. The chamber is defined in part by a pair of elongated walls. An elongated blade, doctor or containment, is positioned on each of the opposite elongated walls. An elongated clamping bar is coupled with a separate one of the wall to rotate about a pivot axis defined by a set of T bars mounted along each wall. One longitudinal edge of each clamping bar holds the blade against a proximal edge of the proximal elongated wall to form an edge of the ink chamber. One or more plungers are movably coupled with the ink unit body and pressed against the clamping bar on a side of the bar pivot axis opposite the one longitudinal edge of the bar so as to pivot the one longitudinal edge of the bar against the proximal edge of the wall to secure the blade there between. The plunger is carried in a conventional toggle clamp. The plunger is an assembly with a spring loaded smaller plunger located at its working tip, which adjusts the plunger automatically for wear and minor dimensional changes in the blade and/or seal. The plunger can be threaded into a threaded sleeve of a conventional toggle clamp to permit further gross adjustment of plunger height/position.

14 Claims, 3 Drawing Sheets

CHAMBERED FLEXOGRAPHIC INK UNITS WITH QUICK-CHANGE, BLADE THICKNESS COMPENSATING CLAMPING MECHANISM

CROSS-REFERENCE TO RELATED APPLICATIONS

This is a continuation-in-part of Provisional U.S. Patent Application No. 60/103,369 filed Oct. 7, 1998 and incorporated by reference herein.

BACKGROUND OF THE INVENTION

Chambered flexographic ("flexo") ink units, employ two opposing, blades—a doctor blade and a sealer or containment blade—together with elastomeric end seals to form an enclosed chamber which contains ink being applied to a metering, ("anilox") roll. These two types of blades will hereafter be referred to collectively as "roll blades". A simplified yet typical flexographic printing system is depicted in FIG. 1 and is indicated generally at 10. A conventional, chambered flexographic ink unit or "inker" 12 adjoins and applies ink to a metering or anilox roll 14 of the system 10. The anilox roll 14 in turn applies its ink to the image carrier 16, typically a "flexo plate cylinder". Cylinder 16 in turn applies its ink to a flexible web 18 typically carried on a central drum 20 rolling against the flexo plate cylinder 16. Ink unit 12 is one of several such units which would be arrayed around the central drum.

As is further indicated in FIG. 2, the ink unit or "inker" 12 includes a body 30, which may be C-shaped in transverse cross section as indicated or of another shape. A recessed chamber 32 is formed into one side of the body facing the anilox roll 14 to receive ink to be printed on the web. A doctor blade 34 is typically clamped to the downstream edge of the holder body 30 by means of screws 38 and a clamping bar 40. A sealer or containment blade 36 is clamped to the upstream edge of the body 30 (see FIG. 1). There is typically one screw 38 every three to five inches of clamping bar 40 on ink units over twenty-two inches in length, (so-called "wide web" equipment) and one screw approximately every inch on ink units under twenty-two inches (so-called "narrow web" equipment). In this clamping configuration, the blades 34, 36 may be aligned to the holder body 30 by means of alignment pins 42 or, in some cases, machined "steps" (not depicted) in the holder body, which engage the back of the blades 34, 36 in a manner similar to the pins 42. Elastic seals 44 (e.g., "O-ring" strips) are provided between the blades 34, 36 and the body 30 to seal the blades with the body.

Doctor blades are typically installed nearly edge (i.e. nearly perpendicular to) on the anilox roll and are subject to significant pressure and wear. For that reason, they are made of steel, typically stainless steel or tool steel or steel otherwise treated to resist wear. Containment blades are generally installed at much shallower angles closer to tangent and are subject to significantly less pressure and wear than doctor blades. For that reason, containment blades are made from non-steel materials and can be made from non-metallic materials such as plastic.

A number of costs and operational problems exist with the existing means of clamping doctor and sealer or containment blades with screws. These are:

(A) Distortion of the clamp bar by non-uniform screw tightening. Uniform torquing of each screw with hand tools is difficult, time consuming and easily frustrated by varying degrees of individual screw-thread ink contamination, wear, damage and corrosion. This is a major cause of waviness, distortion or "ripples" in the clamped blade, resulting in doctoring and print defects and/or shortened blade life, as well as ink leakage paths under wavy, distorted or rippled doctor blades.

(B) Increased costs and/or extended press make-ready time resulting from operators working to prevent or correct holder screw problems described in (A).

(C) Difficult access to the inside of the "jaws" which hold the doctor and containment blades. Fast, easy and complete access to these surfaces is needed to remove dried ink which may be present, inspect jaw surfaces for scratches and other damage and/or replace blade ink seals if they are the type that require access, such as the O-ring strip seal 44 illustrated in FIG. 2. Removing ten or more holder screws to gain this access is very slow.

BRIEF SUMMARY OF THE INVENTION

The invention is a flexographic printer ink unit comprising: an elongated body having an elongated ink chamber recessed into one side of the body, the chamber being defined in part by one elongated wall of the body; an elongated roll blade on the one elongated wall; an elongated clamping bar coupled with the body to rotate about one pivot, one longitudinal edge of the clamping bar holding the roll blade against a proximal edge of the elongated wall such that the roll blade forms an edge of the ink chamber; and a plunger movably coupled with the body and pressed against the clamping bar on a side of the first pivot axis opposite the one longitudinal edge so as to pivot the one longitudinal edge of the clamping bar against the proximal edge of the wall to secure the roll blade there between.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
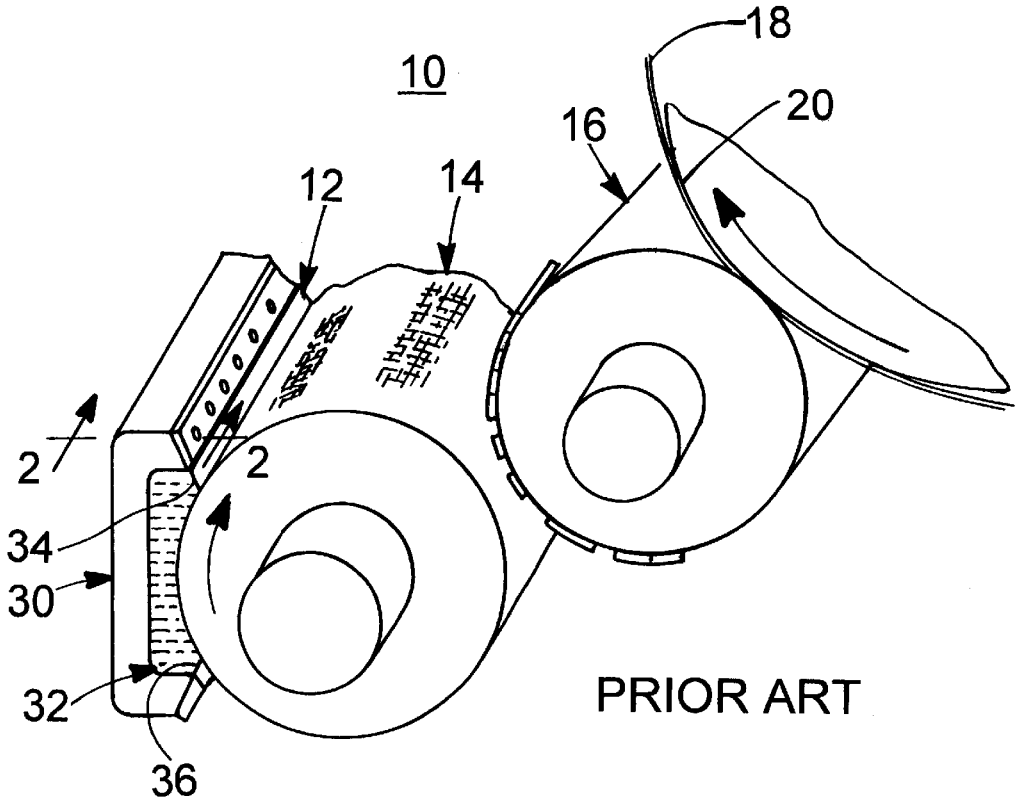
FIG. 1 is a typical prior art doctor blade installation on a chambered flexographic ink unit.

In the drawings, like numerals are used to indicate like elements throughout. Referring to FIGS. 3, 4, 5 and 6 the blade clamping mechanism 50 of the present invention is installed on an ink unit body 60 and uses commercial overcenter clamps (so-called "toggle" clamps) 70 with a novel load distribution and spring loading mechanism that provides rapid positioning, locking and effective sealing of each blade 34, 36 into the jaws formed by the body 60 and a modified clamping bar 80.

Figure 2:
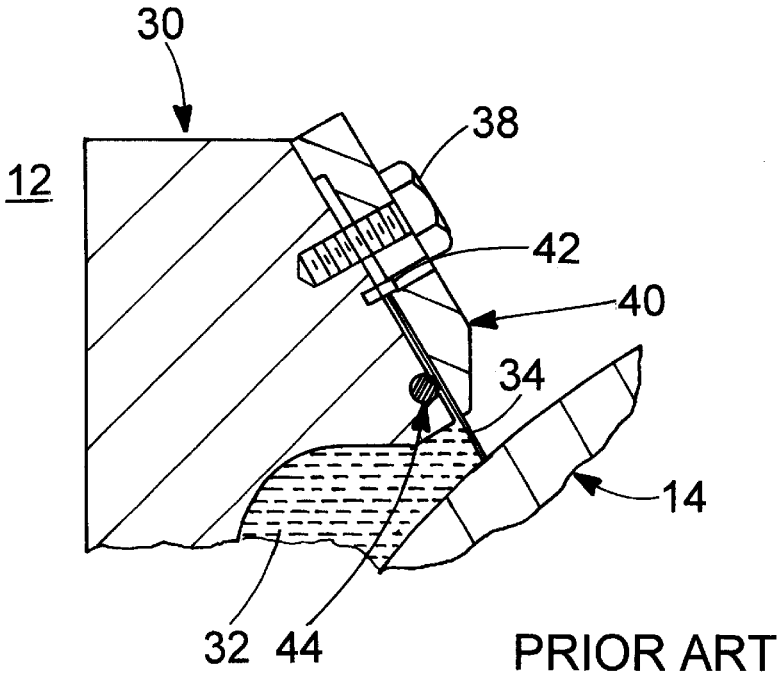
FIG. 2 is a detailed end cross section view of the ink unit body with blade taken along the line 2—2 in FIG. 1.
Figure 3:
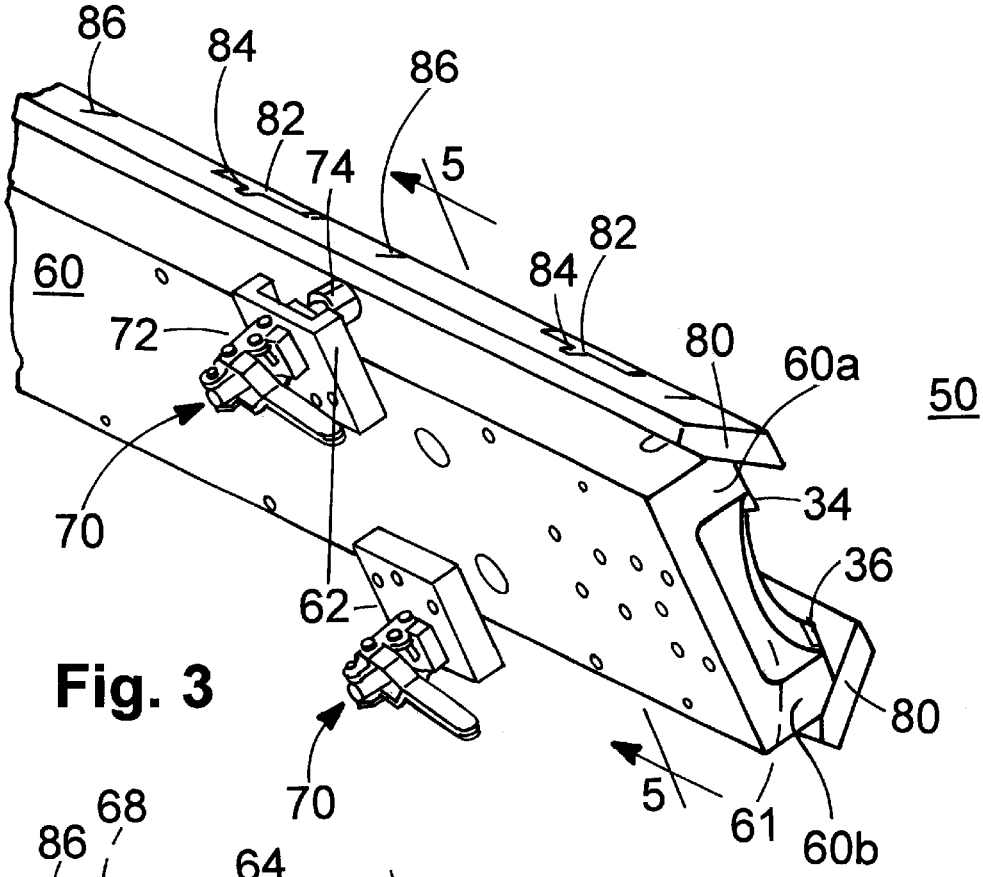
FIG. 3 is a perspective view of an ink unit body incorporating the quick-change blade thickness compensating mechanism of the present invention with the clamping bars in the open position.
Figure 4:
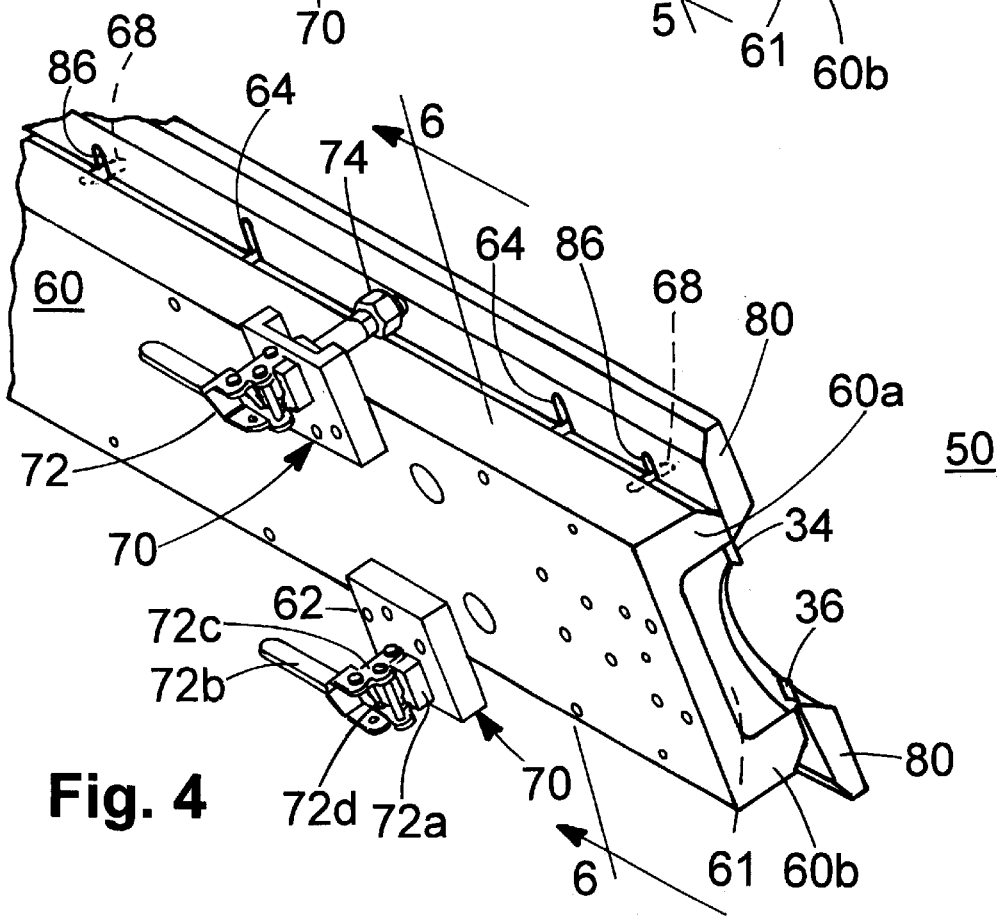
FIG. 4 is a perspective view of an ink unit body incorporating the quick-change blade thickness compensating mechanism of the present invention with the clamping bars in the closed position.
Figure 5:
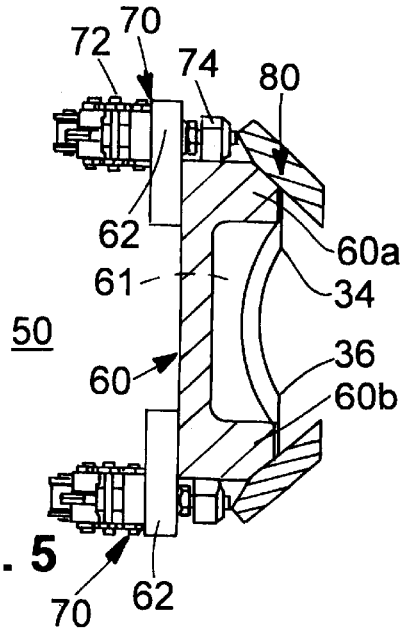
FIG. 5 is a cross sectioned end view of the ink unit body taken along the line 5—5 in FIG. 3.
Figure 6:
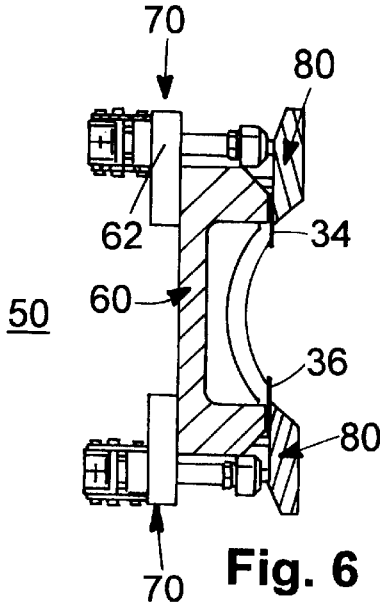
FIG. 6 is a cross sectioned end view of the ink unit body taken along the line 6—6 in FIG. 4.
Figure 8:
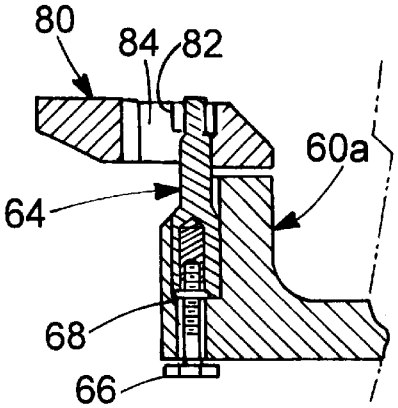
FIG. 8 is a local cross sectional view taken along the lines 8—8 in FIG. 4.

The ink unit body 60 is like conventional body 30 from FIGS. 1 and 2, generally C-shaped and elongated, with a recessed ink chamber 61 defined in part by a pair of opposing, first and second, preferably parallel elongated walls 60*a,* 60*b.* Body 60 has been modified over conventional body 30 of FIGS. 1–2 to support first and second clamps 70 and to pivotally support first and second clamping bars 80. More particularly, brackets 62 are preferably provided on opposite edges on a rear side of the body 60 to support at least one and more preferably at least two clamps 70 on either longitudinal rear edge of the body 60, overhanging the edge. A plurality of preferably identical T-bars 64 are fixed to the body proximal the front opposing edges of the body, spaced along elongated walls 60*a,* 60*b,* where they pivotally support a pair of mirror image clamping bars 80. Referring to FIGS. 3 and 8, elongated cut-outs 82 and sunken bores 84 can be provided in the front faces of the clamping bars 80 to respectively receive cross members and stems of the T-bars 64. Referring to FIG. 8, the stems of the T-bars 64 can be secured to the elongated walls 60*a,* 60*b* of the bodies 60 by suitable fasteners 66 such as screws or bolts. Shims 68 can be provided at the base of the T-bar stems to adjust the height of the T bars and thus the height or position of the clamping bars 80 and of its pivot axis with respect to the body 60 for different blade or blade/seal thicknesses. Suggestedly, the T-bars 64 can be provided along each elongated wall 60*a,* 60*b* approximately eight inches on center with cross members collinear. The T bars 64 support each clamping bar 80 to rotate about a pivot axis defined by the collinear cross members of the T bars. Suggestedly, for up to a thirty inch long clamping bar 80, a pair of toggle clamps 70 should be provided for each bar 80, one for either half of the bar. First and second clamps 70 with first and second plungers are depicted in FIGS. 5 and 6. Longer clamping bars 80 may require more than two toggle clamps. Although the toggle clamps 70 are depicted in FIGS. 3 and 4 as being located between T-bars 64, it is now recommended that the toggle clamps 70 be located directly adjoining a T-bar, if possible. Referring again to FIGS. 3 and 4, it will be appreciated that additional transverse slots 86 may be provided in the clamping bar 80 between the T-bar openings 82/84 to receive alignment (i.e. dowel) pins 68, if such pins are provided on the ink unit body 60 for blade alignment. As is best seen if FIG. 9, an elastic seal 88 is suggestedly provided between the blade 34, 36, which is compressed by the near longitudinal edge of the clamping bar 80 against the proximal front side of the proximal elongated wall 60*a,* 60*b* of the body 60 to seal the blade 34, 36 against the body 60. As can be seen in FIGS. 3–6, an inner edge of each blade 34, 36 overhangs an inner edge of its supporting wall 60*a,* 60*b* so as to define an edge of the ink chamber 61.

The T-bars 64 may be made from oil impregnated, sintered bearing stock for use with a hard anodized, aluminum clamp bar. Alternatively, the T-bars 64 can be made of steel with nylon bearing sleeves lubricated with molybdenum disulfide. Other self-lubricating or non-self-lubricating combinations might be employed.

The clamping bar hinge system comprising T-bars 64 recessed into the clamping bar 80 has several novel functions.

First, the T-bars 64 spread the hold-down and toggle clamp loads imposed on the clamping bar 80. Elimination of concentrated blade clamping loads on the clamping bars 80 is essential to avoiding distortion of the blades (doctor and/or containment) clamped by the bars 80, and because of the basic press geometry related to the flexo ink process, spreading loads merely by means of thick clamp bars is generally impractical.

Second, the T-bars 64 can be provided with a self-lubricating metal surface to avoid binding due to ink contamination and their anchor post height may be adjusted (e.g. by shims 86) to accommodate various ranges of doctor blade thickness and/or sealer strip material. They therefore prevent various binding and distortion phenomenon common to flexo ink unit clamping bars.

Figure 9:
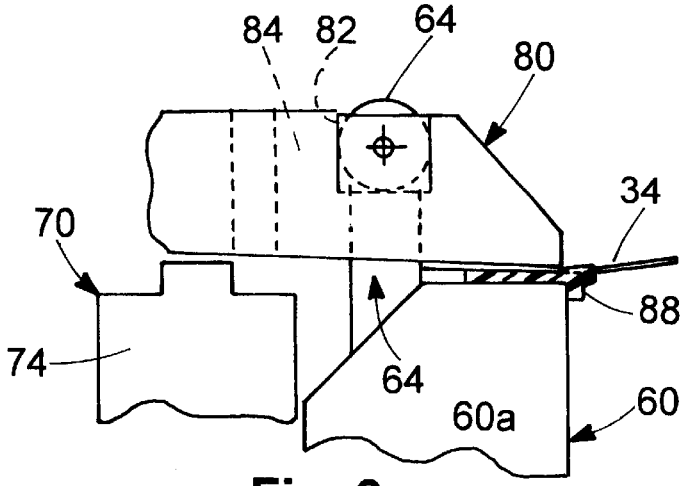
FIG. 9 is a detailed side view of area "9" in FIG. 6 showing the mechanism.

Third, the positioning of the T-bar hinge system allows the anilox side corner of the clamping bar to contact the doctor blade 34 at a small (one to three) degree angle, in effect pinching the blade against the seal 88 along a line contact, thereby causing a small but desirable curvature of the blade 34 across its width in the clamped condition as shown in FIG. 9. This effectively eliminates the well-known tendency of a thin strip of doctor blade to ripple or wrinkle when clamped flat. Although ink unit bodies 60 sometimes provide a blade lifting ridge to provide curvature, the ridge was subject to damage and required a wider blade and larger ink unit dimensions to work.

Figure 7:
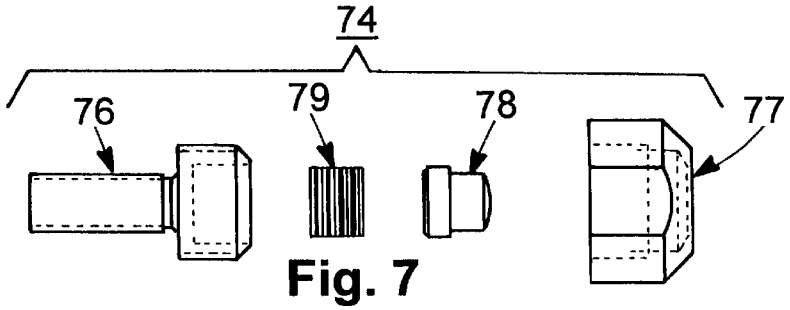
FIG. 7 is an exploded side view of a clamp plunger of the invention.

Each clamp 70 comprises a toggle subassembly 72 mounted by a bracket 62 to the body 60 and a plunger 74 movably coupled to the body 60 and clamping bar 80 on the toggle subassembly 72. Plunger 74 is preferably subassembly itself. FIG. 7 shows details of a preferred plunger 74 subassembly. A main plunger body 76 has one end which is received in the toggle subassembly 72 and an opposite, head or working end, which is capped. The plunger body 76 is preferably externally threaded to removably receive an internally threaded cap 77. Cap 77 captures a second, smaller plunger 78 and preferably one or more spring members 79 such as Belleville washers. The washers 79 are located to permit adjustment of the plunger length and at least resilient if not elastic compression of the plunger 74. A sufficient number of Belleville washers or other spring element(s) 79 are used to provide the desired travel of the smaller plunger 78. The desired travel is that which permits the toggle subassemblies 72 to be moved from the open/blade change position shown in FIGS. 3 and 5 to the over-center, clamped position shown in FIGS. 4 and 6 while maintaining pressure against the clamping bar 80 in the clamped position shown in FIGS. 4, 6 and 9. The plunger 74 is pressed against the clamping bar on a side of the bar pivot axis (defined by the T bars), which is opposite the one longitudinal edge of the clamping bar 80 located against the blade 34 or 36 so as to pivot that edge of the bar 80 against the proximal side of the wall 60*a* or 60*b* to secure the roll blade 34 or 36 there between. The body 76 of the plunger subassembly 70 can be threaded into a sleeve 72*d,* in the toggle subassembly 72 to adjustably receive the plunger 74 and further provide position/height adjustment of the plunger 74 with respect to the toggle subassembly 72 and adjoining wall 60*a,* 60. Referring to FIG. 4, toggle subassembly 72 typically flier includes a base 72*a* and a toggle handle 72*b* pivotally mounted to the base 72*a* on a link 72*c* and pivotally coupled to the sleeve 72*d* with the link 72*c*.

The compressible plunger 70 provides several advantages. It effectively eliminates the need to manually adjust plunger length as the clamping bar and the toggle clamp bearing surfaces and pins undergo normal wear, effectively preventing a loose clamp or jammed-clamp situation. It also avoids exposed mechanical or elastomeric spring elements subject to liquid and/or dried ink damage and contamination, resulting in loss of spring action or mechanical failure of an elastomer spring due to ink solvents. It further provides appropriate compression spring rate and spring alignment in the available space envelope.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A flexographic printer ink unit comprising:

an elongated body having an elongated ink chamber recessed into one side of the body, the chamber being defined in part by one elongated wall of the body;

an elongated roll blade on the one elongated wall;

an elongated clamping bar coupled with the body to rotate about a first pivot axis, one longitudinal edge of the clamping bar holding the roll blade against a proximal edge of the elongated wall to form an edge of the ink chamber; and a plunger movably coupled with the body and pressed against the clamping bar on a side of the one pivot axis opposite the one longitudinal edge so as to pivot the one longitudinal edge of the clamping bar against the proximal edge of the wall to secure the roll blade there between.

2. The flexographic printer ink unit of claim 1 wherein the first pivot axis is adjustably spaced from the one elongated wall of the body.

3. The flexographic printer ink unit of claim 1 wherein the plunger is adjustable in length.

4. The flexographic printer ink unit of claim 1 wherein the plunger is at least resiliently compressible.

5. The flexographic printer ink unit of claim 4 wherein the plunger is part of a toggle clamp assembly fixed to the elongated body.

6. The flexographic printer ink unit of claim 5 wherein the toggle clamp assembly includes a sleeve adjustably receiving the plunger to adjust a position of the plunger with respect to the elongated body.

7. The flexographic printer ink unit of claim 1 wherein the plunger is adjustable in length, at least resiliently compressible, and part of a toggle clamp assembly fixed to the elongated body.

8. The flexographic printer ink unit of claim 1 further comprising a plurality of T bars each having a generally T shape with a stem fixed to one of the elongated body and the clamping bar and a cross member pivotally engaged with a remaining one of the elongated body and the clamping bar so as to pivotally support the clamping bar with respect to the elongated body.

9. The flexographic printer ink unit of claim 8 wherein the first pivot axis is defined by the plurality of T bars, cross members of the T bars being arranged in a single line defining the first pivot axis.

10. The flexographic printer ink unit of claim 9 wherein the T bars are adjustably secured to the elongated wall so that spacing of the first pivot axis from the elongated wall can be varied.

11. The flexographic printer ink unit of claim 10 wherein the plunger is adjustable in length.

12. The flexographic printer ink unit of claim 11 wherein the plunger is at least resiliently compressible.

13. The flexographic printer ink unit of claim 12 wherein the plunger is part of a toggle clamp assembly fixed to the elongated body.

14. The flexographic printer ink unit of claim 1 further comprising:

a second elongated wall of the body located opposite the one elongated wall and defining part of the ink chamber;

a second elongated roll blade on the second wall;

a second elongated clamping bar coupled with the body to pivot about a second axis parallel to the one pivot axis, one longitudinal edge of the second clamping bar holding the second roll blade against a proximal side of the second elongated wall to form a second edge of the chamber, and a second plunger movably coupled with the body and pressed against the second clamping bar on a side of the second axis opposite the one longitudinal edge of the second clamping bar so as to pivot the one longitudinal edge of the second clamping bar against the proximal edge of the second elongated wall to secure the second roll blade there between.

* * * * *